United States Patent [19]

Yashfe

[11] Patent Number: 4,551,613

[45] Date of Patent: Nov. 5, 1985

[54] RAPID-HEATING ELECTRIC WATER BOILER

[76] Inventor: Yechiel Yashfe, 37 Nikanor St., Jerusalem, Israel

[21] Appl. No.: 531,299

[22] Filed: Sep. 12, 1983

[51] Int. Cl.[4] ..... H05B 1/02; H05B 3/82; F24H 1/20

[52] U.S. Cl. ..... 219/316; 126/361; 126/362; 219/301; 219/306; 219/312; 219/318; 219/331; 219/336

[58] Field of Search ..... 219/296–299, 219/301, 306, 307, 308, 309, 310–312, 314, 316, 318, 328, 331; 126/361, 362

[56] References Cited

U.S. PATENT DOCUMENTS

| | | | |
|---|---|---|---|
| 981,481 | 1/1911 | Shoenberg | 219/301 X |
| 1,734,075 | 11/1929 | Christian | 219/301 X |
| 2,446,367 | 8/1948 | Graves | 219/314 |
| 2,507,902 | 5/1950 | Graves | 219/314 |
| 2,977,454 | 3/1961 | Volker | 219/331 |

FOREIGN PATENT DOCUMENTS

| | | | |
|---|---|---|---|
| 238333 | 2/1965 | Austria | 219/331 |
| 1173225 | 7/1964 | Fed. Rep. of Germany | 219/297 |
| 337268 | 2/1936 | Italy | 219/301 |
| 513516 | 2/1955 | Italy | 219/316 |
| 518425 | 3/1955 | Italy | 219/312 |
| 1013943 | 12/1965 | United Kingdom | 219/306 |

*Primary Examiner*—A. Bartis

*Attorney, Agent, or Firm*—Sandler & Greenblum

[57] ABSTRACT

A rapid-heating electric water boiler includes a boiler vessel having an access opening at the lower portion thereof defined by a connecting flange. A boiler jacket surrounds the vessel but is spaced therefrom to provide a clearance filled with thermal insulation. A mounting flange is watertightly but removably attached to the connecting flange to close the access opening. A cold-water inlet pipe and a hot-water pass through the mounting flange into the vessel with the outlet pipe terminating in a free end adjacent the top of the vessel. A water-immersible metallic sheathed electric resistance heating element is attached to and in intimate thermal contact with the outlet pipe starting substantially from the lower end thereof at the flange and extending along at least a major portion of the length of the outlet pipe toward the free end thereof for simultaneously heating the water within the outlet pipe as well as the water in the vessel. The heating element is controlled by a thermostat having a sensor mounted on the interior of the mounting flange. To prevent overheating of the uppermost water levels in the vessel the sensor is thermally connected by a thermal conductor to the free end of the outlet pipe.

12 Claims, 2 Drawing Figures

RAPID-HEATING ELECTRIC WATER BOILER

Figures 1, 2:
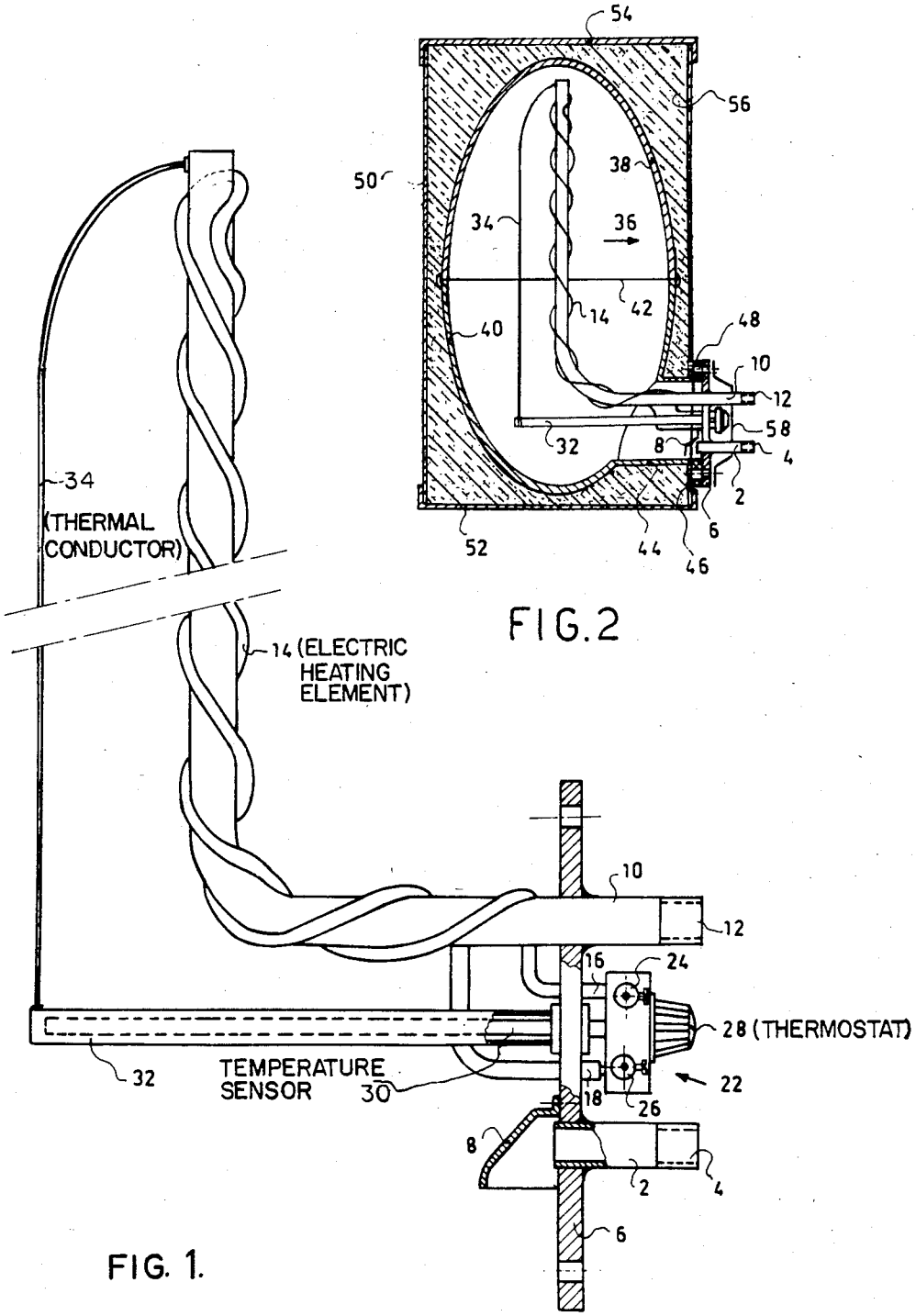

The present invention relates to a rapid-heating device for water boilers, especially for domestic water boilers. It also relates to a water boiler incorporating such a device.

Conventional water boilers appear to have changed very little during the last couple of decades. Manufacturers continue to copy, and thus perpetuate, each others faulty designs and still cling to the notion, apparently accepted by an uncritical public, that the daily hot-water requirements of the average family can only be met by a large 120–150 liter capacity boiler having a low watt-density heating element of about 12.5 W/liter. Yet the large-capacity domestic boiler can be shown to be utterly inefficient in its use of energy, and its continued use by millions of households constitutes, on a national scale, a staggering waste of resources.

To attain, with a boiler of this capacity, a reasonable proportion between diameter and length, the diameter has to be quite large, about 45–50 cm. Now it can be shown that, beyond a certain critical boiler-vessel diameter which is about 35–40 cm, heating will set up a convection-caused circulation that will result in a substantial uniformity of temperature throughout the boiler. That is, in order to take a shower requiring about 20 *l* of water of a temperature of 39°–40° C., it is necessary to heat 120–150 *l* of water to a temperature of at least 60° C. (since the cold water entering the boiler when hot water is drawn, immediately mixes with the already heated water volume, bringing down its temperature. Depending on the season, this takes 2–4 hours. Needless to say, much of the caloric content of the water mass is lost during the night, not only due to the imperfections of the insulating layer, but also via the pipe lines.

At the other end of the spectrum of available water-heating devises there is the so-called "instant" or "throughflow" heater, which basically consists of a relatively narrow tube on which is wound a high-wattage electrical heating element. Water flowing through this tube is heated during its passage. This type of heater, which has no storage capacity at all, suffers from several disadvantages: it cannot supply more than one point, say, either the kitchen-sink faucet or the shower, but not both; the temperature of the water supplied by it is very difficult to control and to keep constant, and, finally, its narrow tube becomes clogged after relatively short use, due to the deposition, inside this tube, of boiler scale.

It is one of the objects of the present invention to overcome the disadvantages of the prior-art water-heating devices and to provide a device that combines the advantages of the storage heater and of the "throughflow" heater while being free of their respective drawbacks as above described; a device which will rapidly heat a quantity of water sufficient for 2–3 showers or one bath, while instantly providing smaller quantities of hot water, and which will not be fouled up by boiler scale, even with water of the highest mineral content.

The present invention provides a rapid-heating device for an electric water boiler having an access opening in the lower portion thereof, the device including a flange for closing said access opening when the flange is attached to said boiler. Both a cold-water inlet pipe and a hot-water outlet pipe pass through said flange, the hot-water inlet pipe terminating in a free end adjacent the top of the boiler when the flange is attached thereto. A water-immersible electrical heating element is attached to and is in intimate thermal contact with a substantial portion of said hot water pipe. With this arrangement, heat is applied to the water in the hot-water pipe throughout its length.

The invention also consists in a rapid-heating electric water boiler that includes a boiler-vessel having an access opening at the lower portion thereof defined by a connecting flange. A boiler-jacket surrounds said boiler-vessel but is spaced therefrom to provide clearance; and an insulating envelope substantially fills said clearance. A mounting flange is watertightly, but removably attached to said connecting flange through which both a cold-water inlet pipe and a hot-water outlet pipe pass, the hot-water outlet pipe terminating in a free end adjacent the top of said vessel. Finally, a water-immersible electrical heating element is attached to and is in intimate thermal contact with a substantial portion of said hot-water pipe.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 is a partly cross-sectional view of the device according to the invention, and FIG. 2 is a cross-sectional view of an electric water boiler incorporating the device of FIG. 1.

Referring now to the drawings, there is seen in FIG. 1 a cold-water inlet pipe 2 designed to lead into the lower portion of a water boiler, as can be seen in FIG. 2, a drawing to be discussed further below. The inlet end 4 of this pipe 2 is threaded, for connection to the cold-water supply. The cold-water inlet pipe is watertightly attached, preferably by welding or brazing, to a flange 6 which carries also the other components of the device according to the invention, as will be explained further below. To prevent jets of cold water from pipe 2 from shooting into already heated water layers when hot water is withdrawn (and, of course, is at once replaced by an equivalent quantity of cold water), an inlet baffle 8 is provided, which diffuses the cold-water inflow and deflects it downwards.

Equally attached to the flange 6 is a hot-water outlet pipe 10 designed to lead into the upper portion of a water boiler, again as seen in FIG. 2. The outlet end 12 of this pipe 10, the diameter of which can vary, e.g., between ½" and 1", is threaded for connection to a hot-water line or to such flowcontrol means as a mixing faucet or the like. The very fact that all components of the device (which, as will be explained further below, may include also a thermostat and its associated parts) are attached to the flange 6 constitutes a great convenience in manufacture and, particularly, in installation.

In the preferred embodiment of FIGS. 1 and 2 the hot-water pipe 10 is bent, entering the boiler vessel horizontally and then rising vertically. This is, however, only due to the fact that in the present embodiment, as is clear from FIG. 2, the flange 10 is located at the side, rather than below, the boiler vessel. While this arrangement has the advantage of reducing the overall height of the water boiler, embodiments with the flange 10 below the boiler are also envisaged, in which case the hot-water pipe 10 would obviously be straight.

An immersible, so-called "wetted", electric heating element 14 is coiled around the pipe 10 and fixedly attached to it, preferably by soldering, a heavy solder fillet providing intimate thermal contact between the pipe 10 and the element 14. This arrangement provides instant hot water without the above-discussed disadvantages of the so-called through-flow heaters.

The coiling is advantageously of the "bifilar" type, accordingly one end 16 of the element is near the other end 18. On these two ends (from the very tips of which the jacket and insulation have of course been removed) is seated the head 20 of a thermostat 22 which also comprises the terminals 24, 26 for connection to electrical power, the setting knob 28, the sensor 30 and the watertight sheath 32.

To prevent overheating of the uppermost water layers (considering the fact that the thermostat 22 is located in a relatively cool region of the boiler), a thermal conductor 34 is provided, thermally connecting the upper end of the hot-water pipe 10 and the thermostat sheath 32, and carrying heat from the former to the latter. This heat is duly sensed and, if excessive, power is cut off before any damage can be done. The specific wattage of the heating element in intentionally chosen to be relatively high, e.g. between 2 to 4 KW for a single phase, but not limited to a single phase only.

A preferred embodiment of the rapid-heating water boiler according to the invention incorporating the above-explained heating device is shown in FIG. 2. The shape of the boiler vessel 36 is oval and the vessel is advantageously fabricated from two cup-or bowl-shaped sheet-metal members 38, 40 easily produced by any of the known sheet-metal forming processes such as drawing, spinning, or the like. The two members 38, 40 are welded together at their rims 42. The lower vessel member 40 is provided with an access socket 44 and a connecting flange 46. It is to this flange 46 that, by means of bolts and nuts (not shown) and via a sealing gasket 48, the flange 6 is fixedly attached.

As already explained, the socket 44 projects sideways, thereby reducing overall height for installation in low storage spaces, but could also extend below the vessel 36 in coaxiality therewith.

The vessel 36 is surrounded with clearance by a protective jacket 50, including a bottom 52 and a lid 54, the clearance being filled with an insulating envelope 56, preferably of foamed polyurethane. A protective cover 58 encloses the thermostat 22 and its electrical terminals.

Boiler capacity is 10–70 liters and the diameter of the vessel 36 at the joined rims 42 is preferably about 35 cm, but at most 40 cm. As already explained, at such diameters, heating the water will not set up the convectional circulation that, in conventional water boilers, causes immediate mixing and thus a substantial uniformity of temperature throughout the boiler, but will produce a thermal layering, with the heated water rising to the top and staying there, ready for immediate use. For the same reason it is no longer necessary to heat the water to 60° C., in order to obtain an output temperature of about 40° C., as the inflowing cold water replacing the outflowing hot water does not penetrate, and mix with, the warmer layers.

It should also be mentioned that because the heating element of the device is of the wetted type, the inevitable boiler scale will form on the element itself, rather than inside the hot-water pipe 10, thus obviating the danger of clogging due to scale deposition. What is more, whatever scale forms on the outside of the heating element 14 soon cracks and sinks to the bottom of the vessel, due to the large temperature differences which the brittle scale cannot accommodate.

It will be evident to those skilled in the art that the invention is not limited to the details of the foregoing illustrative embodiments, and that the present invention may be embodied in other specific forms without departing from the essential attributes thereof, and it is therefore desired that the present embodiments be considered in all respects as illustrative and not restrictive, reference being made to the appended claims, rather than to the foregoing description, and all changes which come with the meaning and range of equivalency of the claims are therefore intended to be embraced therein.

What is claimed is:

1. A rapid-heating device for an electric water boiler having an access opening in the lower portion thereof, comprising:

(a) a flange adapted to close the access opening in the lower portion of an electric water boiler when the flange is attached to said boiler;

(b) a cold-water inlet pipe passing through said flange;

(c) a hot water outlet pipe having a lower end passing through said flange and a free end adapted to terminate adjacent the top of the boiler when the flange is attached thereto; and (d) a water-immersible, wetted electrical heating element attached to and in intimate thermal contact with said hot water outlet pipe starting substantially from the lower end thereof at said flange and extending along a major portion of the length of said outlet pipe towards the free end thereof for simultaneously heating both water contained inside said hot water outlet pipe as well as water surrounding said hot water outlet pipe.

2. A rapid-heating device according to claim 1 including a sensor mounted on the interior of said flange for generating temperature information related to temperature in the boiler, and a thermostat mounted on the exterior of said flange and electrically connected to said heating element for controlling the application of electrical power thereto in response to said temperature information.

3. The device as claimed in claim 2, further comprising a thermal conductor thermally connecting the free end of said hot-water outlet pipe and said sensor for the purpsoe of preventing overheating of the upper water layers in the water boiler as well as damage to said heating element by conducting heat therefrom to said sensor.

4. A rapid-heating device according to claim 3 including a water tight sheath mounted on the inside of said flange and containing said temperature sensor, the thermal conductor being thermally connected to said sheath.

5. The device as claimed in claim 4, wherein said electric heating element is bifilarly wound around said hot-water outlet pipe.

6. A rapid-heating electric water boiler comprising:

(a) a boiler-vessel having at the lower portion thereof an access opening provided with a connecting flange;

(b) a boiler-jacket surrounding said boiler-vessel with clearance;

(c) insulating material substantially filling said clearance;

(d) a mounting flange watertightly, but removably, attached to said connecting flange;

(e) a cold-water inlet pipe passing through said mounting flange;

(f) a hot-water outlet pipe having a lower end passing through said mounting flange and terminating in a free end adjacent the top of said vessel; and (g) means for heating water; and (h) said means for heating consisting of a single water-immersible, wetted electrical heating element attached to and in intimate thermal contact with said hot water outlet pipe starting sutstantially from the lower end thereof at said flange and extending along a major portion of said outlet pipe towards the free end thereof for simultaneously heating both water contained inside said hot-water outlet pipe as well as water surrounding said hot-water outlet pipe.

7. The water boiler as claimed in claim 6, wherein said boiler vessel is substantially oval in shape and is fabricated from two substantially cup-shaped sheet-metal members joined together at their rims.

8. The water boiler as claimed in claim 6, wherein said access opening and said connecting flange project laterally from said lower boiler-vessel portion.

9. The water boiler as claimed in claim 6, wherein the maximum dimension of said boiler-vessel is at most 40 cm.

10. The water boiler as claimed in claim 6, wherein the capacity of said vessel is at most 70 liters.

11. A rapid-heating electric water boiler according to claim 6 including a sensor mounted on the interior of said flange for generating temperature information related to temperature in the boiler, and a thermostat mounted on the exterior of said flange and electrically connected to said heating element for controlling the application of electrical power thereto in response to said temperature information.

12. A rapid-heating electric water boiler according to claim 11 including a water tight sheath mounted on the inside of said flange and containing said temperature sensor, and a thermal conductor thermally connected to said sheath and said free end of said hot-water outlet pipe.

* * * * *

UNITED STATES PATENT AND TRADEMARK OFFICE

CERTIFICATE OF CORRECTION

PATENT NO. : 4,551,613

DATED : November 5, 1985

INVENTOR(S) : Yechiel YASHFE

It is certified that error appears in the above-identified patent and that said Letters Patent is hereby corrected as shown below:

Column 3, line 5, change "10" to ---6---.

Column 3, line 9, change "10" to ---6---.

Column 3, line 34, change "in" to ---is---.

Column 4, line 60, change "purpsoe" to ---purpose---.

Signed and Sealed this

*Twenty-third* Day of *September 1986*

[SEAL]

*Attest:*

DONALD J. QUIGG

*Attesting Officer*

*Commissioner of Patents and Trademarks*